US006196398B1

(12) United States Patent
Lowe

(10) Patent No.: US 6,196,398 B1
(45) Date of Patent: Mar. 6, 2001

(54) HANGER APPARATUS AND METHOD OF MOUNTING THE SAME

(76) Inventor: Richard B. Lowe, 5515 Rosslyn Ave., Indianapolis, IN (US) 46205

( * ) Notice: Subject to any disclaimer, the term of this patent is extended or adjusted under 35 U.S.C. 154(b) by 0 days.

(21) Appl. No.: 09/111,962

(22) Filed: Jul. 8, 1998

(51) Int. Cl.[7] ..... A47F 5/00
(52) U.S. Cl. ..... 211/96; 211/87.01
(58) Field of Search ..... 211/96, 87.01, 211/100, 168; 248/201, 300

(56) References Cited

U.S. PATENT DOCUMENTS 1,435,110 * 11/1922 Efford ..... 211/96
1,818,761 * 8/1931 Sendler ..... 211/96 X
2,561,806 * 7/1951 Mailland ..... 211/96
2,633,997 * 4/1953 Johnson ..... 211/96
2,732,161 * 1/1956 Moriarty ..... 248/300 X
4,721,212 * 1/1988 Lowe ..... 211/96 X
5,085,389 * 2/1992 Levesque ..... 248/300
5,897,086 * 4/1999 Condon ..... 248/300 X

* cited by examiner

*Primary Examiner*—Robert W. Gibson, Jr.
(74) *Attorney, Agent, or Firm*—Patula & Associates PC

(57) ABSTRACT

A hanging apparatus is disclosed comprising a first end pole and a second end pole with a plurality of middle poles therebetween in axial alignment. Positioned between and pivotably mounted between the end poles and the middle poles are a plurality of hanger bars for receiving an article such as clothing or the like. The hanger bars are free to pivot about the pole axis. The end poles each include an angled bracket which allows the hanging apparatus to be mounted to a door frame between the door and the door frame. In this manner, the hanging apparatus extends away from the door in close proximity to the door frame to allow the hanging of numerous articles without interfering with use of the door. Alternatively, the hanging apparatus and each angled bracket can be mounted directly to a wall to provide for a hanging apparatus to be located in any position on a wall. The hanging bars remain free to be pivoted about the pole axis.

15 Claims, 7 Drawing Sheets

HANGER APPARATUS AND METHOD OF MOUNTING THE SAME

The present invention relates to a hanger apparatus or hanging article such as clothing, towels, etc. The present invention further relates to a method of mounting the same. Specifically, the present invention relates to a hanger apparatus capable of being mounted in a door frame or directly to a wall and having a plurality of independently movable hanger bars.

BACKGROUND OF THE INVENTION

Individuals are often searching for additional space in their homes to hang articles of clothing (such as coats, towels and other articles) due to a lack of closet space or overcrowded closets or simply for organization or ease of access in a specific location.

One solution to the need for extra hanging space is disclosed in my previous U.S. Pat. No. 4,721,212 entitled "MODULAR ARTICLE SUPPORT UNIT" issued to myself on Jan. 26, 1988. This patent discloses a modular article support unit comprising an elongated tubular member adapted to be removably attached to the hinge pins of a door by means of adjustable brackets. Said elongated tubular member having a plurality of holes along the length thereof for removably attaching several different types of support devices such as coat hooks, towel racks, bulletin boards and mirrors. While this invention has adequately served the need for hanging space for several years, there are some disadvantages with the same. For example, the modular article support unit must be mounted in a fixed location, i.e., in the hinges of a door. This limits an individual's ability to locate the support unit in any desired location. Further, the support devices attached to the support unit are likewise limited in that they are fixedly mounted thereto. The present invention overcomes these problems and disadvantages in the prior art hanger apparatuses.

BRIEF SUMMARY OF THE INVENTION

The present invention comprises a hanger apparatus and method of mounting the same. The hanger apparatus comprises two end poles each having an angled mounting bracket thereto. Mounted between each end pole are a plurality of middle poles or spacers and a plurality of hanger bars pivotably mounted between the end poles and middle poles. The angled brackets of the end poles are situated in such a manner to allow flexibility and ease in mounting the hanger apparatus of the present invention in a door jam or door frame at any location along the door frame and along either side of the door frame without interfering with use of the door. The angled brackets further allow the hanger apparatus to be mounted directly to a wall.

Accordingly, it is the principal object of the present invention to provide a hanger apparatus that is flexible in mounting, as well as easy to mount.

It is a further object of the present invention to provide independently movable hanger bars on the hanger apparatus of the present invention.

It is another object of the present invention to provide a hanger apparatus which is capable of mounting to a door frame without interfering with the use of a door.

Numerous other advantages and features of the invention will become readily apparent from the detailed description of the preferred embodiments of the invention, from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENTS OF THE PRESENT INVENTION

Figure 1:
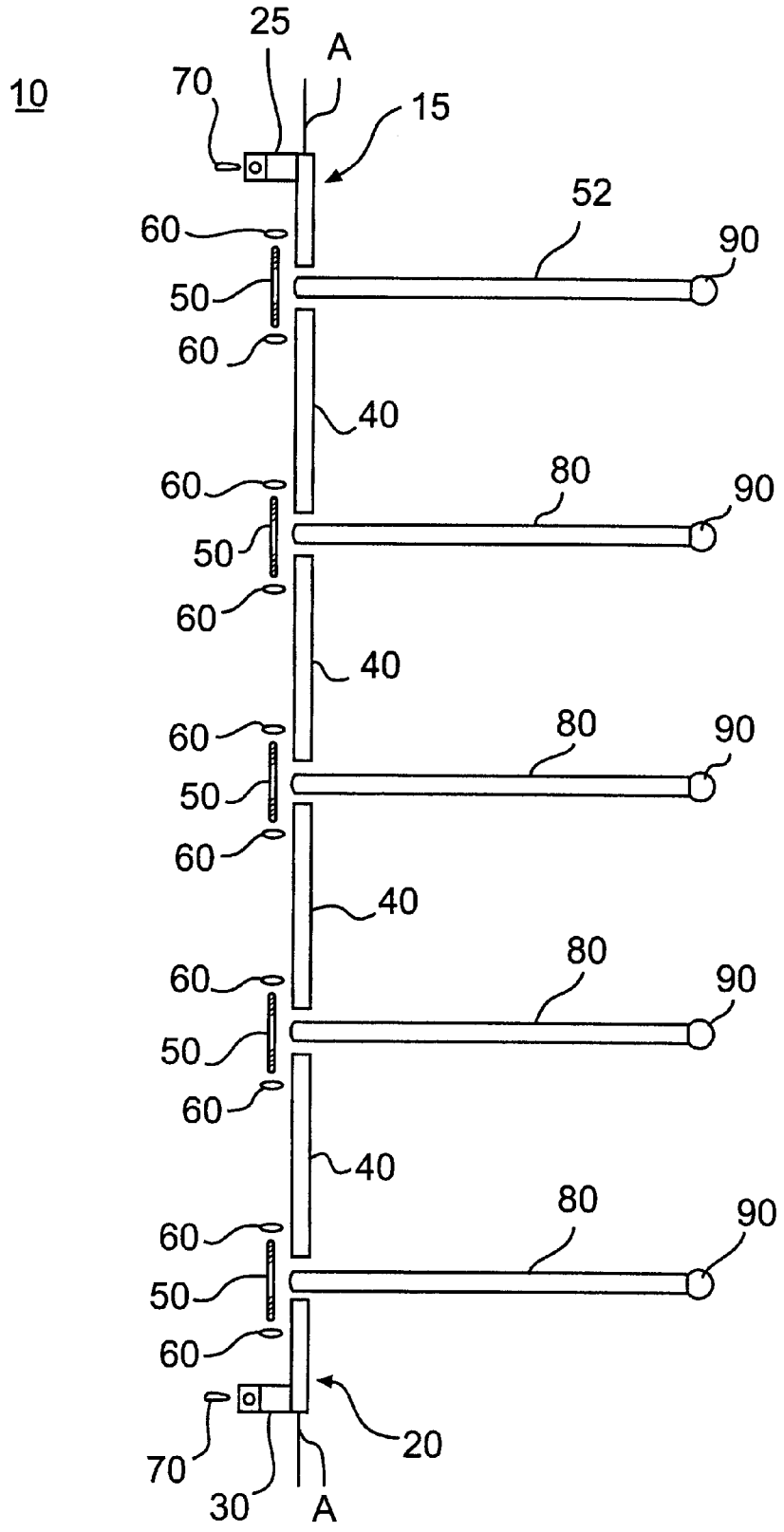
FIG. 1 is an exploded front plan view of the present invention.

While the invention is susceptible of embodiment in many different forms, there is shown in the drawings and will be described herein in detail preferred and alternate embodiments of the present invention. It should be understood, however, that the present disclosure is to be considered an exemplification of the principles of the invention and is not intended to limit the spirit and scope of the invention and/or claims of the embodiment illustrated.

FIG. 1 illustrates one embodiment of the present invention 10 comprising two end poles 15 and 20 each having an angled mounting bracket 25 and 30, respectively. Mounted between the end poles are a plurality of middle poles 40. Positioned between the middle poles and end poles are a plurality of hanger bars 80 having ball caps 90. Each of the adjacent end poles and middle poles are fastened together via dowel screws 50 which pass through a hole in the ends of the hanger bars 80. As such, hanger bars 80 are free to be pivoted about the dowel screws 50 and thus about the pole axis A. Washers 60 are provided on dowel screws 50 between the poles and the hanger bars to allow for ease of movement of the hanger bars. Angled mounting brackets 25 and 30 are suitably mounted in a door frame or to a wall by mounting screws 70.

Figure 2:
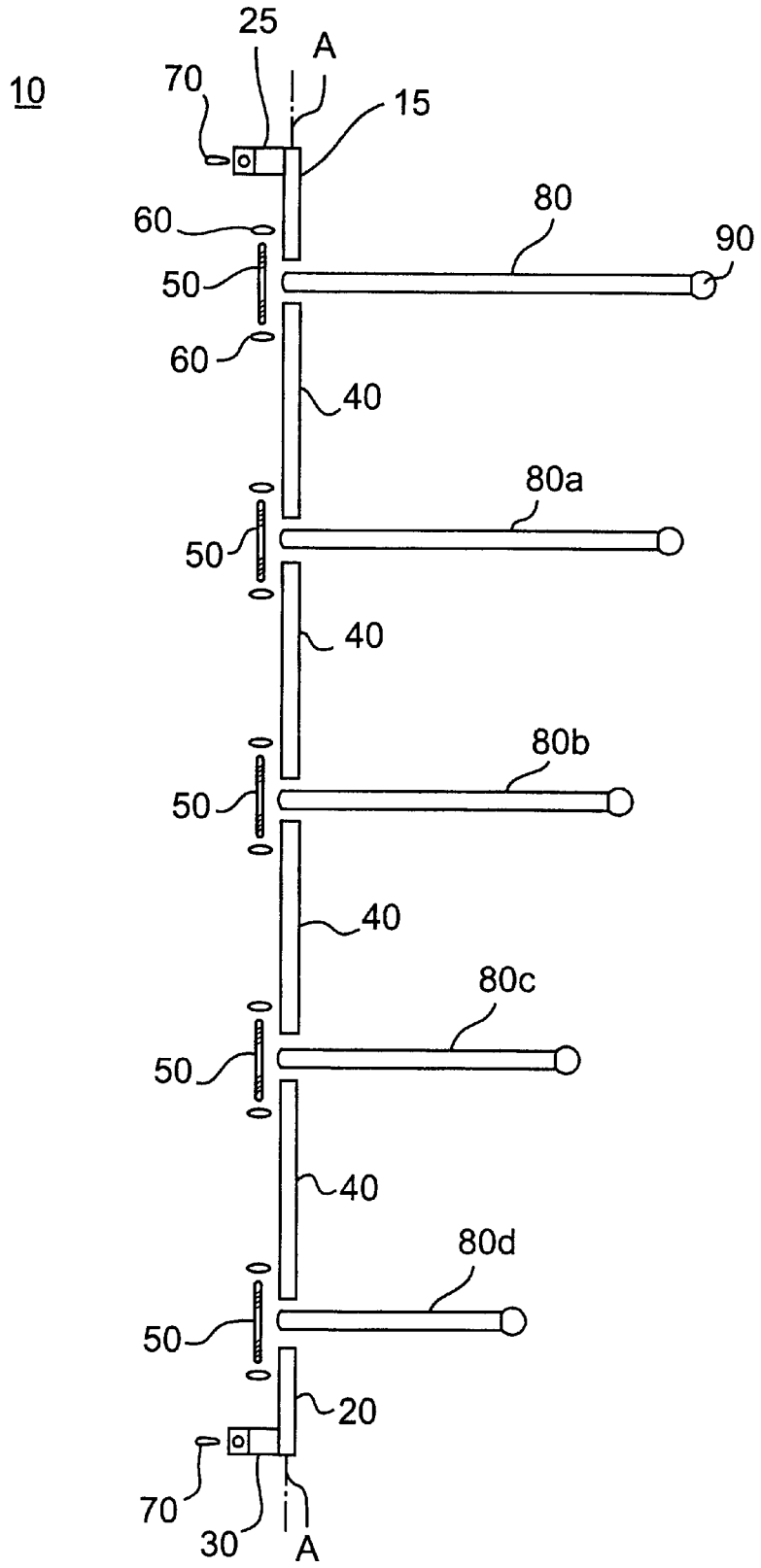
FIG. 2 is an exploded front plan view of an alternate embodiment of the present invention.

FIG. 2 illustrates an alternative embodiment of the present invention 10 wherein the hanger bars are of various lengths illustrated by hanger bars 80, 80*a*, 80*b*, 80*c* and 80*d*, each decreasing in length respectively. However, it should be understood that hanger bars 80 could be any length and could be placed in any order along the poles 15, 20 and 40. Further, it should be understood that the present invention could accommodate any number of hanger bars of any size and shape.

Figure 3:
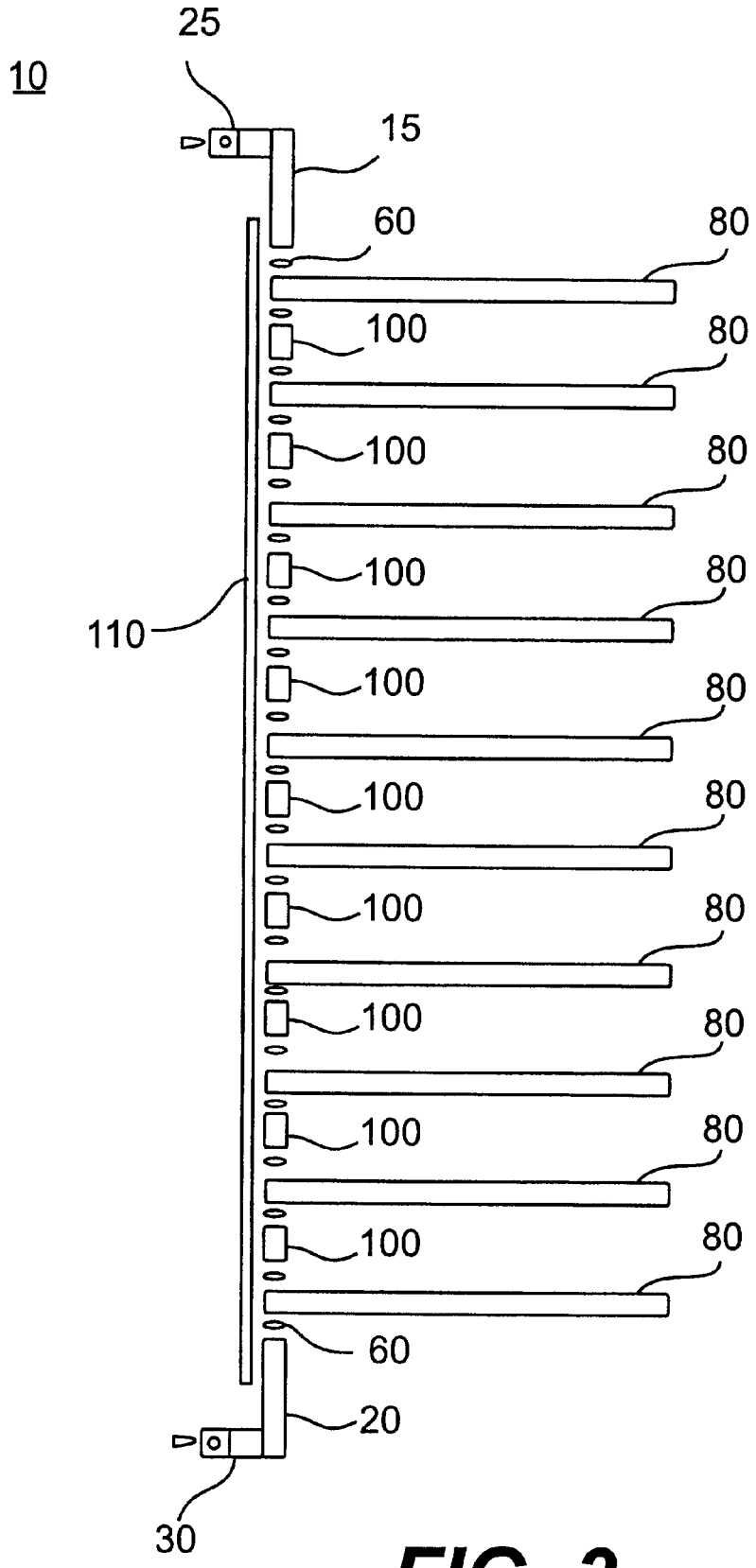
FIG. 3 is an exploded front plan view of another an alternate embodiment of the present invention.

FIG. 3 illustrates an alternate embodiment of the present invention 10 wherein middle poles 40 have been replaced by a plurality of spacer elements 100 and dowel screws 50 have been replaced by a dowel rod 110. This embodiment allows a greater number of hanger bars 80 to be attached to the invention 10. In this embodiment, hanger bars 80 do not include ball caps 90 for ease in placing and removing articles therefrom.

Figures 4, 5, 6:
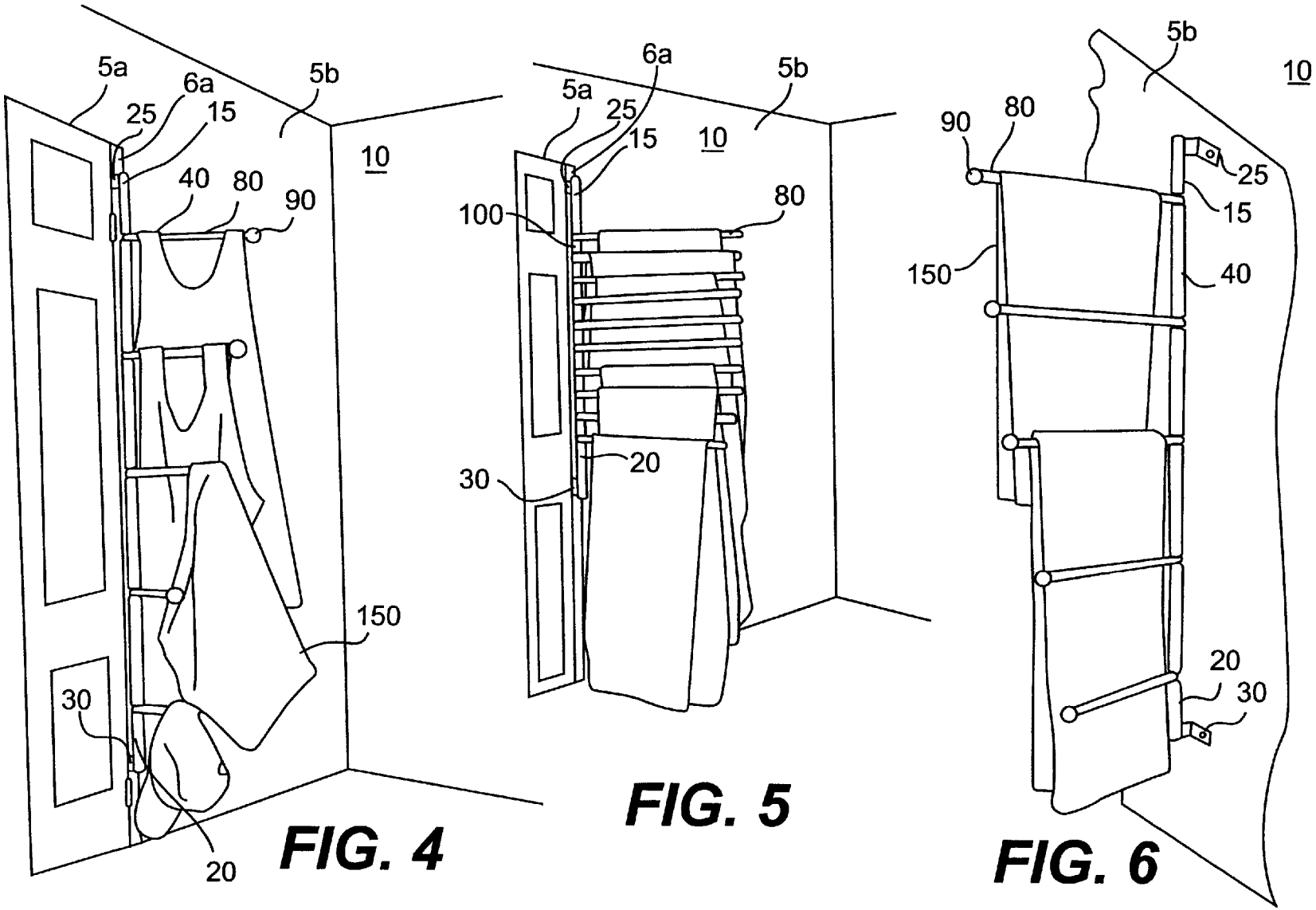
FIG. 4 illustrates the embodiment of FIG. 2 in use mounted in a door frame.
FIG. 5 illustrates the embodiment of FIG. 3 in use mounted in a door frame.
FIG. 6 illustrates the embodiment of FIG. 1 in use mounted to a wall.

FIG. 4 illustrates the present invention 10 mounted to a door frame wherein the angled mounting brackets 25 and 30 of end poles 15 and 20, respectively, are positioned between the door 5*a* and its frame 6*a* and secured thereto by mounting screws 70. Wall 5*b* is illustrated for reference. As such, the invention 10 angles away from door 5*a* to a position in line with and in close proximity of the door frame (see FIG. 14). In this manner, the hanger apparatus of the present invention is located in a position which will be free from interference from the door 5*a* when in use. The hanger bars 80 of the present invention receive an article 150 such as clothing and can be pivoted to any location about the pole axis A. The pivoting feature of the hanger bars 80 allow the bars 80 to rotate with the door should the bars be in a position which would come into contact with the door when the door is open. In this manner, the bars simply pivot with the door and the articles 150 remain on the hanger apparatus of the present invention.

Similarly, FIG. 5 illustrates one embodiment of the present invention mounted into a door frame with angle brackets 25 and 30 being positioned between door 5*a* and its frame 6*a*. It should be understood that the hanger apparatus of the present invention could be suitably mounted at any location along the door frame. This provides greater flexibility, for example, the apparatus could be hung toward the bottom of the door frame to allow easy reach for children.

FIG. 6 illustrates one embodiment of the present invention 10 in use mounted directly to a wall. As can be seen, angled brackets 25 and 30 of end poles 15 and 20, respectively, attach directly to a wall 5*b*. In this manner, end poles 15, 20 and middle poles 40 are spaced away from the wall a distance defined by the angled bracket, and hanger bars 80 are free to rotate about the pole axis A.

Figure 7:
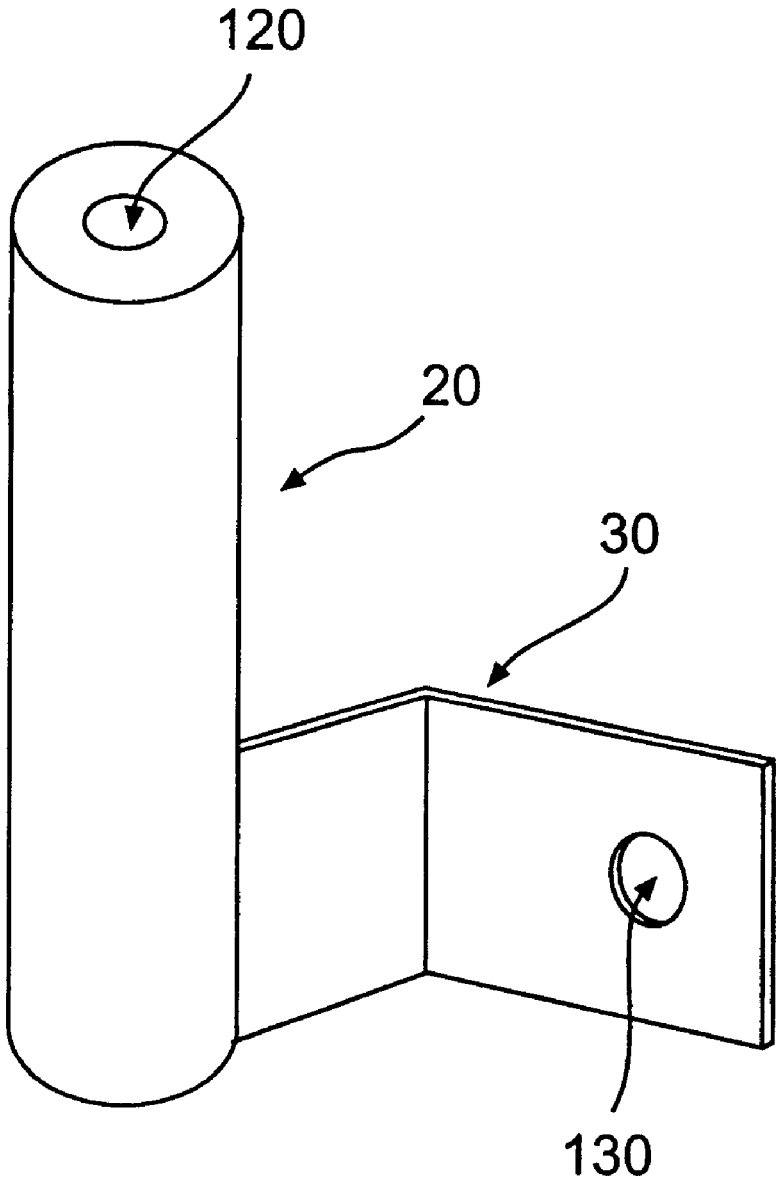
FIG. 7 illustrates a perspective view of an end pole of the present invention.

FIG. 7 illustrates the end pole 20 having angled bracket 30. End pole 20 includes a bore 120 for receiving a dowel screw 50 or a dowel rod 110 therein. Angled bracket 30 includes a screw hole 130 for receiving a mounting screw therethrough. It should be understood that end pole 20 is equivalent to end pole 15 in all respects other than the angled brackets 30 and 25, respectively, wherein the angled brackets 25 and 30 have opposite bends in the angled bracket or a mirror image bend. This is necessary so that the end poles 15 and 20 can cooperate to mount the invention properly.

Figure 8:
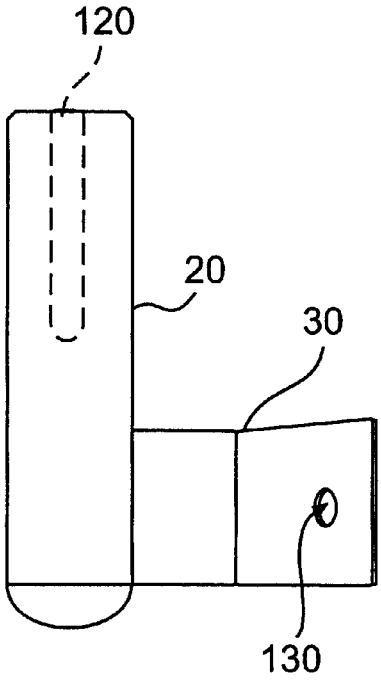
FIG. 8 illustrates a front plan view of the end pole of FIG. 7.
Figure 9:
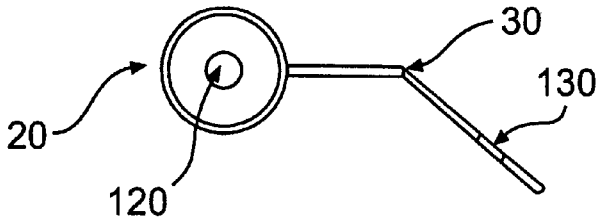
FIG. 9 illustrates a top plan view of the end pole of FIG. 8.
Figure 10:
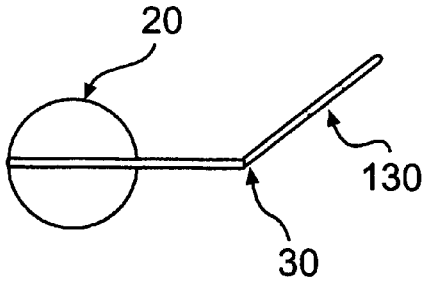
FIG. 10 illustrates a bottom plan view of the end pole of FIG. 8.
Figure 11:
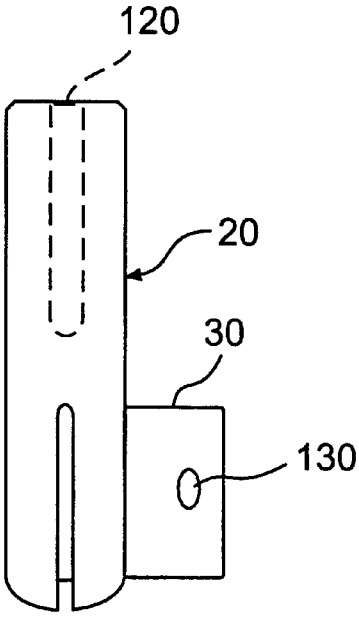
FIG. 11 illustrates a left side plan view of the end pole of FIG. 8.
Figure 12:
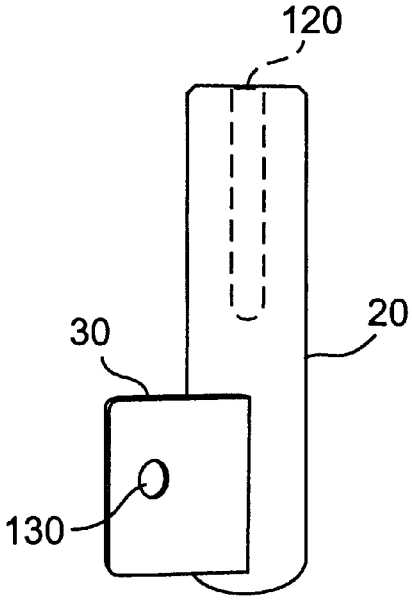
FIG. 12 illustrates a right side plan view of the end pole of FIG. 8.

FIGS. 8 through 12 illustrate front, top, bottom, left side and right side views, respectively, of end pole 20 having angled bracket 30. End pole 20 includes bore 120, and bracket 30 includes hole 130. As can be seen in FIGS. 8–10, the angle bracket 30 includes a first portion extending substantially perpendicular to end pole 20 and an angled portion extending at an angle from the first portion which is mounted to end pole 20.

Figure 13:
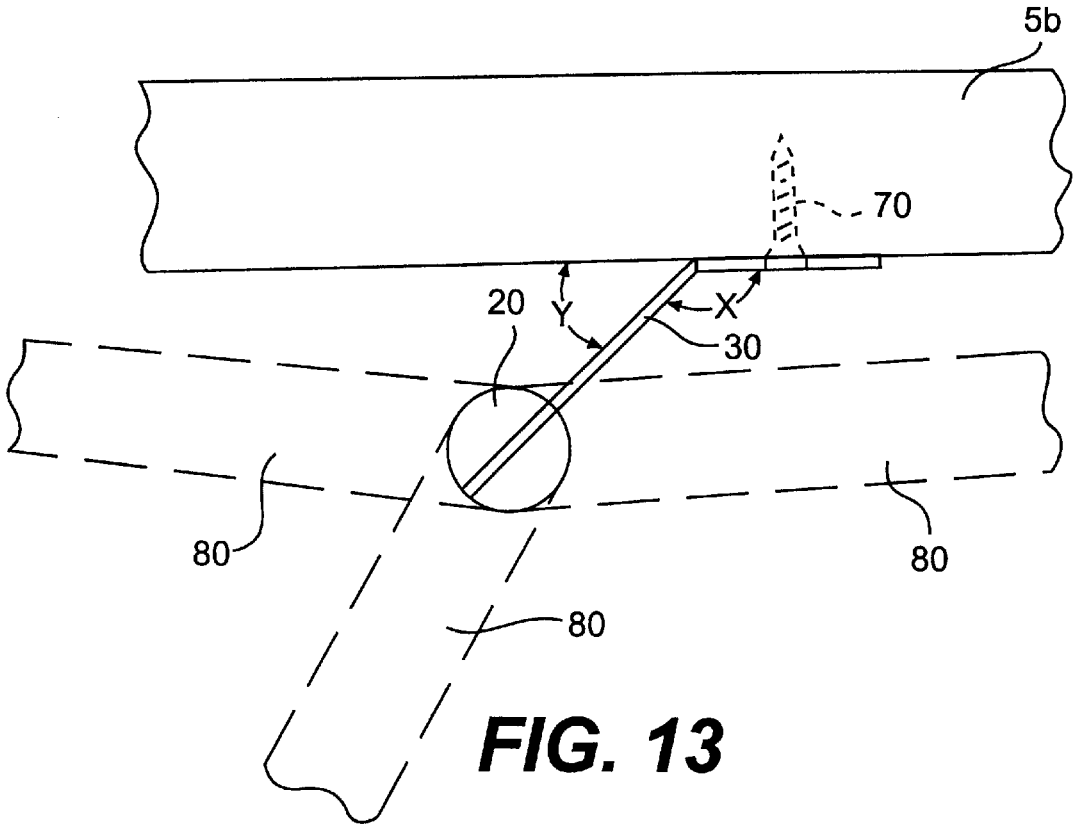
FIG. 13 illustrates a top plan view of the present invention mounted to a wall.
Figure 14:
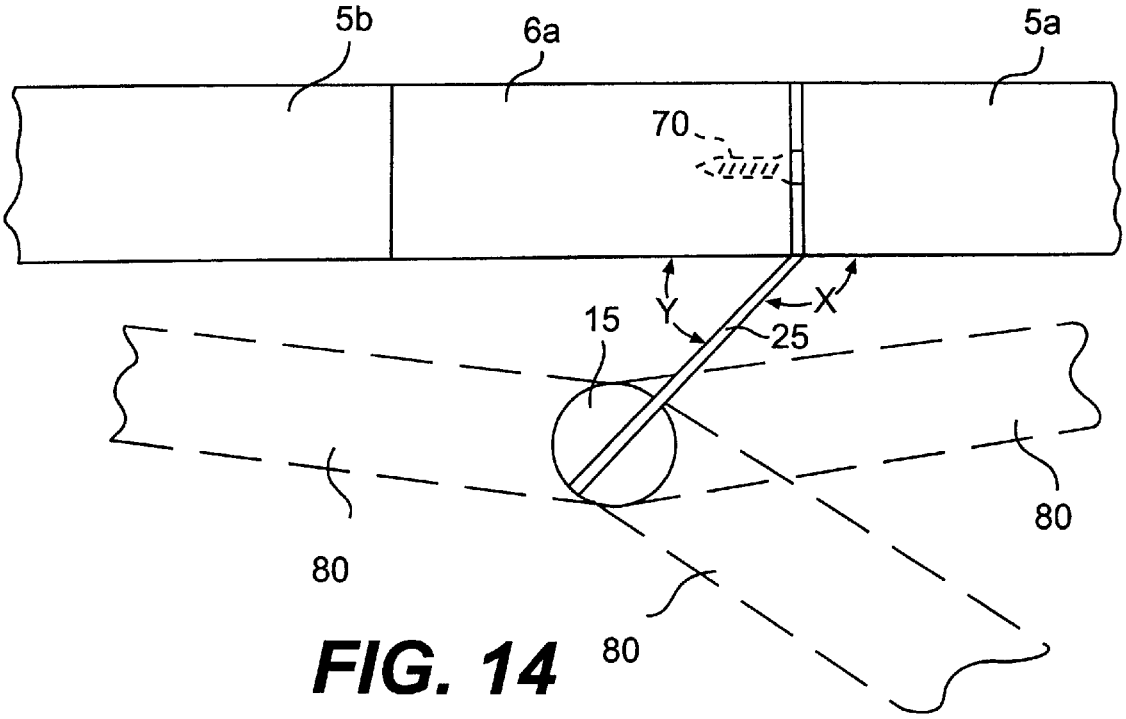
FIG. 14 illustrates a top plan view of the present invention mounted to a door frame.

Preferably, as seen in FIGS. 13 and 14, the angle of the brackets between the first portion and the angled portion is preferably approximately 135° (angle x) such that when the angled portion is mounted to a wall 5*b* (FIG. 13), for example, the end pole and the attached portion of the bracket extend away from the wall 5*b* at an angle of approximately 45° (angle Y). Similarly, when the angled bracket 30 is mounted to a door frame 6*a* (FIG. 14), the end pole 20 and first portion of the angled bracket extend away from the door and outward in front of the door frame at an angle of approximately 45° (angle Y).

It is to be understood that the embodiments herein described are merely illustrative of the principles of the present invention. Various modifications may be made by those skilled in the art without departing from the spirit or scope from the claims which follow.

What is claimed is:

1. A hanger apparatus selectively mountable proximate to a door and a door, said door and said door frame defining a space therebetween; said apparatus comprising:

at least one mounting bracket suitably supporting said hanger apparatus, said at least one mounting bracket including a first section and a second section extending at an angle to said first section;

said at least one mounting bracket includes a first mounting bracket at an end of said hanger apparatus and a second mounting bracket at an opposite end of said hanger apparatus;

said first mounting bracket and said second mounting bracket are affixed to end poles of said hanger apparatus;

wherein the angle between said first section and said second section being approximately 135 degrees.

2. The hanger apparatus of claim 1, wherein said second section of said mounting bracket being configured to locate in said space between said door and said door frame, said second section being configured to mount to said door frame.

3. The hanger apparatus of claim 2, wherein said first section of said mounting bracket is configured to extend away from said door frame at an angle of approximately 45 degrees.

4. The hanger apparatus of claim 1, wherein said hanger apparatus further includes a plurality of hanger bars situated between said end poles.

5. The hanger apparatus of claim 4, wherein said plurality of hanger bars are pivotably mounted on said hanger apparatus.

6. The hanger apparatus of claim 4, wherein said plurality of hanger bars are of varying lengths.

7. The hanger apparatus of claim 4, wherein said plurality of hanger bars are spaced apart by a plurality of spacer poles.

8. The hanger apparatus of claim 4, wherein said hanger bars include ball caps at the ends thereof.

9. A hanger apparatus comprising:

at least one end section;

a dowel received in said at least one end section;

at least one hanger bar pivotably mounted on said dowel; and a mounting bracket suitably connected to said at least one end section;

said mounting bracket including a first portion and second angled portion, said second angled portion including a means for mounting to a structure;

wherein an angle between said first portion and said second angled portion is approximately 135 degrees.

10. The hanger apparatus of claim 9, wherein said structure is a wall, said first portion extending away from said wall at an angle of approximately 45 degrees.

11. The hanger apparatus of claim 9, wherein said structure is a door frame, said second portion configured to locate and mount in a space between said door frame and an associated door without interfering with the operation of the door.

12. The hanger apparatus of claim 11, wherein said first portion extends away from said door frame at an angle of approximately 45 degrees.

13. The hanger apparatus of claim 9, wherein said at least one end section includes a first end section and an opposite end section, each including said mounting bracket.

14. The hanger apparatus of claim 13, wherein said at least one hanger bar includes a plurality of hanger bars.

15. A method of mounting a hanger apparatus comprising:

providing on said hanger apparatus a mounting bracket configured to locate in a space between a door and a door frame;

angling said mounting bracket to define a first portion and a second portion defining an angle of approximately 135 degrees; and mounting said second portion of said mounting bracket to said door frame in said space such that said first portion of said mounting bracket extends away from said door frame at an angle of approximately 45 degrees.

* * * * *